US007104754B2

(12) United States Patent
Willshee et al.

(10) Patent No.: US 7,104,754 B2
(45) Date of Patent: Sep. 12, 2006

(54) VARIABLE VANE ARRANGEMENT FOR A TURBOMACHINE

(75) Inventors: Matthew J Willshee, Derby (GB); Dale E Evans, Derby (GB)

(73) Assignee: Rolls-Royce plc, London (GB)

( * ) Notice: Subject to any disclaimer, the term of this patent is extended or adjusted under 35 U.S.C. 154(b) by 96 days.

(21) Appl. No.: 10/844,405

(22) Filed: May 13, 2004

(65) Prior Publication Data

US 2004/0240989 A1 Dec. 2, 2004

(30) Foreign Application Priority Data

May 27, 2003 (GB) ..... 0312097.9

(51) Int. Cl.
*F04D 29/40* (2006.01)

(52) U.S. Cl. ..... 415/159; 415/229

(58) Field of Classification Search ..... 415/159, 415/160, 161, 162, 163, 164, 229
See application file for complete search history.

(56) References Cited

U.S. PATENT DOCUMENTS 3,887,297 A 6/1975 Welchek 3,990,810 A * 11/1976 Amos et al. ..... 415/161

FOREIGN PATENT DOCUMENTS

GB 2 339 244 A 1/2000

* cited by examiner

*Primary Examiner*—Igor Kershteyn
(74) *Attorney, Agent, or Firm*—W. Warren Taltavull; Manelli Denison & Selter PLLC

(57) ABSTRACT

A vane arrangement for a compressor of a gas turbine engine comprises a plurality of circumferentially arranged vanes, a plurality of levers and a control ring. Each vane comprises a fixed upstream portion secured to a casing and a movable downstream portion pivotally mounted to the casing. The movable portion of each vane is pivotally mounted at the upstream end of the movable portion adjacent the fixed portion of the respective vane. The movable portion of each vane has a spindle extending through an aperture in the casing. Each aperture in the casing has an elongate shape in cross-section and each aperture has a bush arranged within the aperture and around the spindle to fill the elongate shaped aperture. The downstream end of the fixed portion of each vane has substantially the same shape as the upstream end of the movable portion of the respective vane.

15 Claims, 2 Drawing Sheets

VARIABLE VANE ARRANGEMENT FOR A TURBOMACHINE

FIELD OF THE INVENTION

The present invention relates to a variable vane arrangement for a turbomachine, and in particular relates to a variable vane arrangement for a compressor of gas turbine engine.

BACKGROUND OF THE INVENTION

A variable vane arrangement for a turbomachine, as disclosed in our UK patent application GB2339244A, comprises a plurality of circumferentially arranged vanes, a plurality of operating levers and a control ring. Each vane comprises an upstream portion secured to a casing and a movable downstream portion pivotally mounted to the casing of the turbomachine. Each operating lever is pivotally mounted at a first end to the control ring and each operating lever is mounted at second end to a spindle of the movable downstream portion of a respective one of the vanes. Rotation of the control ring causes the levers to adjust the angular position of the movable downstream portions of the vanes.

In this variable vane arrangement the movable downstream portions of the vanes are pivotally mounted about an axis adjacent the upstream ends of the movable downstream portions and downstream of the downstream ends of the fixed upstream portions of the vanes.

Also in this variable vane arrangement the radially outer ends of the downstream ends of the upstream portions of the vanes are shaped to allow the radially outer ends of the upstream ends of the movable downstream portions of the vanes to be inserted into apertures in the casing.

A problem with this variable vane arrangement is that when each vane is fully assembled, there is an undesirable gap between the shaped radially outer end of the downstream end of the fixed upstream portion of the vane and the radially outer end of the upstream end of the movable downstream portion of the vane. In operation these gaps allow a leakage flow from the concave pressure surfaces to the convex suction surfaces of the vanes which may be a source of aerodynamic forcing, or aeromechanical excitation, on the stage of rotor blades downstream of the vanes. The aerodynamic forcing may cause the rotor blade to vibrate and reduce the working life of the rotor blade.

SUMMARY OF THE INVENTION

Accordingly the present invention seeks to provide a novel variable vane assembly for a turbomachine which reduces, preferably overcomes, the above mentioned problems.

Accordingly the present invention provides a variable vane arrangement for a turbomachine comprising a plurality of circumferentially arranged vanes, a plurality of operating levers and a control ring, each vane comprising a fixed portion secured to a casing of the turbomachine and a movable portion pivotally mounted to the casing, each operating lever being pivotally mounted at a first end to the control ring, each operating lever being mounted at second end to a respective one of the vanes, the movable portion of each vane being movable between a first position in which the movable portion of each vane is pivotally mounted about an axis at an end of the movable portion and the axis is adjacent the fixed portion of the respective vane and a second position in which the movable portion of each vane is displaced from the fixed portion of the respective vane to allow assembly or disassembly of the movable portion of each vane.

Preferably the movable portion of each vane having a spindle arranged to extend through a respective aperture in the casing, each aperture in the casing having an elongate shape in cross-section to allow the movable portion of each vane to move between the first position and the second position.

Preferably each aperture having a bush arranged within the aperture and around the spindle to fill the elongate shaped aperture when the movable portion of each vane is in the first position.

Preferably the end of the fixed portion of each vane having substantially the same shape as the adjacent end of the movable portion of the respective vane.

Preferably each variable vane comprising an upstream portion fixed to the casing and a movable downstream portion pivotally mounted to the casing.

Preferably the variable vanes being pivotally mounted about pivot axes arranged substantially radially to the axis of the turbomachine.

Preferably each elongate shape aperture extending substantially axially relative to the axis of the turbomachine.

Preferably each aperture being generally keyhole shape in cross-section.

Preferably the turbomachine is a gas turbine engine. Preferably the turbomachine is a turbojet or turbofan gas turbine engine.

Preferably the variable vane arrangement is for a compressor or a fan.

The present invention also provides a variable vane for a turbomachine comprising a fixed portion secured to a casing of the turbomachine and a movable portion pivotally mounted to the casing, the movable portion of the vane being movable between a first position in which the movable portion of the vane is pivotally mounted about an axis at an end of the movable portion and the axis is adjacent the fixed portion of the vane and a second position in which the movable portion of the vane is displaced from the fixed portion of the vane to allow assembly or disassembly of the movable portion of the vane.

Preferably the movable portion of the vane having a spindle arranged to extend through an aperture in the casing, the aperture in the casing having an elongate shape in cross-section to allow the movable portion of the vane to move between the first position and the second position.

Preferably the aperture having a bush arranged within the aperture and around the spindle to fill the elongate shaped aperture when the movable portion of the vane is in the first position.

Preferably the end of the fixed portion of the vane having substantially the same shape as the adjacent end of the movable portion of the vane.

BRIEF DESCRIPTION OF THE DRAWINGS

The present invention will be more fully described by way of example with reference to the accompanying drawings in which.

DETAILED DESCRIPTION OF THE INVENTION

Figure 1:
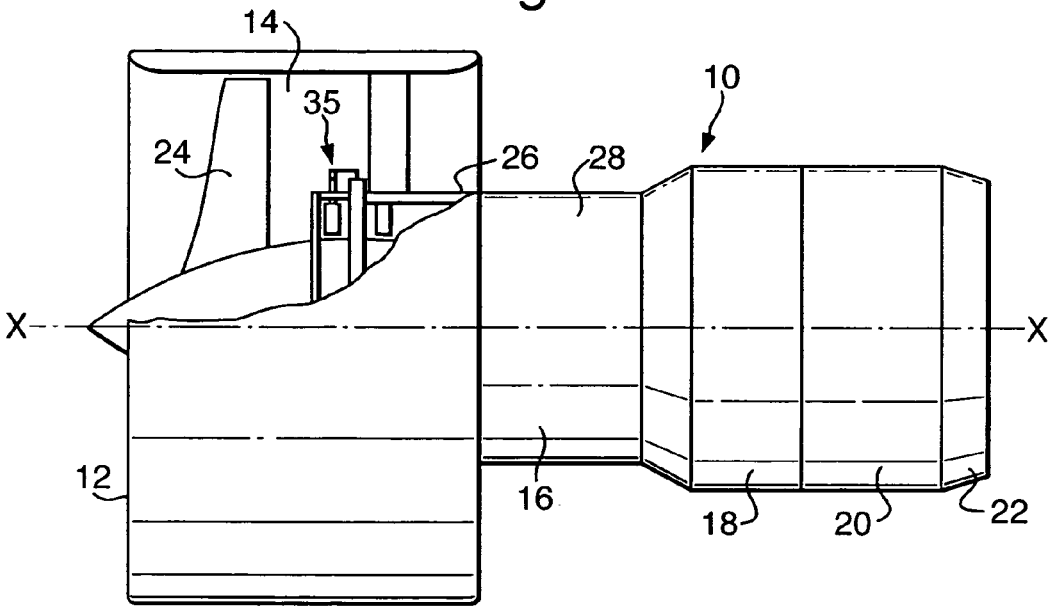
FIG. 1 is a partially cut away view of a turbofan gas turbine engine having a variable vane arrangement according to the present invention.

A turbofan gas turbine engine 10, as shown in FIG. 1, comprises in axial flow series an intake 12, a fan section 14, a compressor section 16, a combustion section 18, a turbine section 20 and a core exhaust 22. The turbine section 20 comprises a low-pressure turbine (not shown) arranged to drive a fan 24 in the fan section 14 and a high-pressure turbine (not shown) arranged to drive a high-pressure compressor 28 in the compressor section 16. The turbine section 20 may also comprise an intermediate-pressure turbine arranged to drive an intermediate-pressure compressor 26 in the compressor section 16.

The intermediate-pressure compressor 26 comprises a casing 30 and a rotor 32 arranged for rotation about an axis X. The rotor 32 carries one or more axially spaced stages of circumferentially arranged radially outwardly extending compressor blades 34. The intermediate-pressure compressor 26 also comprises a variable vane arrangement 36 for adjusting the angle of the airflow onto the stage of compressor blades 34 immediately downstream thereof.

Figure 2:
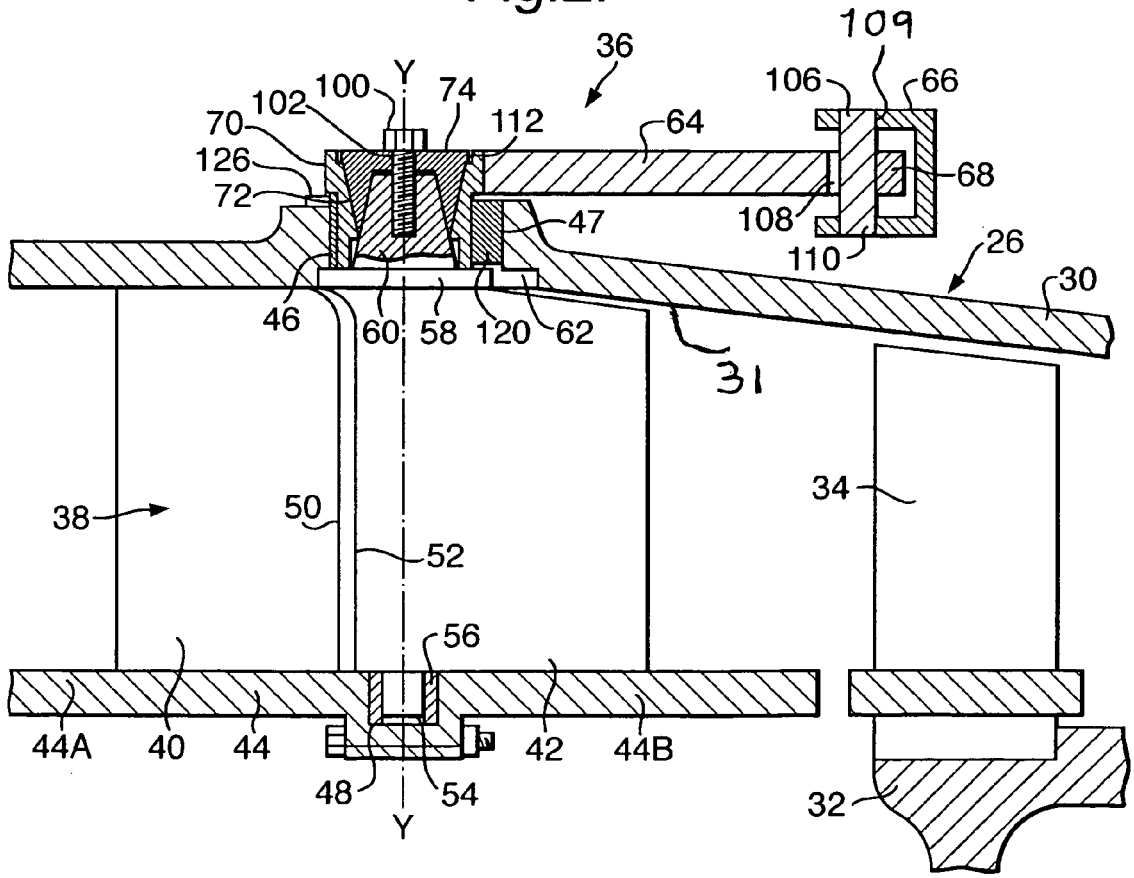
FIG. 2 is an enlarged cross-sectional view of a variable vane arrangement according to the present invention.
Figure 3:
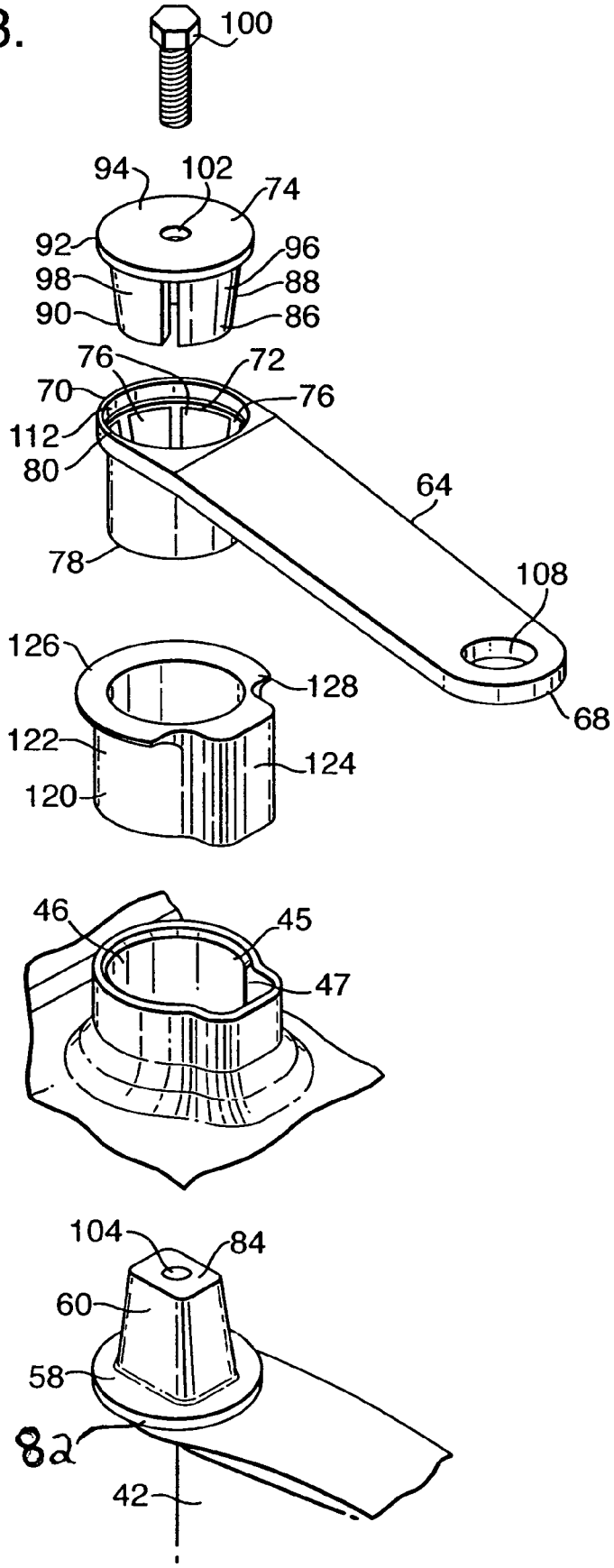
FIG. 3 is an exploded view of a casing boss, a spindle of a vane, an operating lever, a drive member and a bush of the variable vane arrangement shown in FIG. 2.

The variable vane arrangement 36, as shown more clearly in FIGS. 2 and 3, comprises a plurality of radially extending circumferentially arranged variable vanes 38, a plurality of operating levers 64, a control ring 66 and an actuator (not shown).

Each variable vane 38 comprises a fixed upstream portion 40 and a movable downstream portion 42. The fixed upstream portion 40 of each of the variable vanes 38 is secured at its radially outer end to the casing 30 and is secured at its radially inner end to a ring 44. The movable downstream portion 42 each of the variable vanes 38 is pivotally mounted at its radially outer end in a respective aperture 46 in the casing 30 and is pivotally mounted at its radially inner end in a respective aperture 48 in the ring 44. The movable downstream portion 42 of each of the variable vanes 38 is pivotally mounted about one of a plurality of circumferentially spaced axes Y arranged substantially in a plane arranged perpendicularly to the axis X of the rotor 32. The axes Y are arranged adjacent the upstream ends 52 of the movable downstream portions 42 of the variable vanes 38 and adjacent, slightly downstream of, the downstream ends 50 of the fixed upstream portions 40 of the variable vanes 38. The ring 44 comprises an upstream portion 44A and a downstream portion 44B, which are joined together along the radial plane containing the pivot axes Y by axially extending bolts and nuts extending through apertures in flanges on the upstream portion 44A and downstream portion 44B. The ring 44 has a plurality of circumferentially spaced apertures 48 defined between the edges of the upstream portion 44A and the downstream portion 44B of the ring 44. The radially inner end of the movable downstream portion 42 of each of the variable vanes 38 is provided with a cylindrical spindle 54 which locates coaxially in a bearing member, or bush, 56 in the respective aperture 48 in the ring 44. The radially outer end of the movable downstream portion 42 of each of the variable vanes 38 is provided with a cylindrical bearing member 58 and a spindle 60. The bearing member 58 locates coaxially in an increased diameter portion 62 of the respective aperture 46 adjacent the inner surface 31 of the casing 30.

Each operating lever 64 is pivotally mounted at a first end 68 to the control ring 66 and each operating lever 64 is pivotally mounted at second end 70 to the movable downstream portion 42 of a respective one of the variable vanes 38. The second end 70 of each operating lever 64 forms a cylindrical bush for location coaxially in the aperture 46 in the casing 30. The second end 70 of each operating lever 64 comprises a multi-sided aperture 72 and the movable downstream portion 42 of each variable vane 38 has a multi-sided spindle 60 which locates in the multi-sided aperture 72 of the respective operating lever 64. Each operating lever 64 has a drive member 74 located in the multi-sided aperture 72 and around the multi-sided spindle 60 of the movable downstream portion 42 of the respective variable vane 38. Each drive member 74 engages the respective multi-sided aperture 72 and the respective multi-sided spindle 60 to transmit drive from the operating lever 64 to the movable downstream portion 42 of the respective variable vane 38.

The sides 76 of each multi-sided aperture 72 taper from a first end 78 adjacent the movable downstream portion 42 of the respective variable vane 38 to a second end 80 remote from the movable downstream portion 42 of the respective variable vane 38. Thus the cross-sectional area of the aperture 72 increases from the first end 78 to the second end 80. The sides of each multi-sided spindle 60 taper from a first end 82 adjacent the movable downstream portion 42 of the respective variable vane 38 to a second end 84 remote from the movable downstream portion 42 of the respective variable vane 38. Thus the cross-sectional area of the spindle 60 increases from the second end 84 to the first end 82.

Each drive member 74 has multiple sides on an inner surface 86 to engage the respective multi-sided spindle 60 and multiple sides on an outer surface 88 to engage the respective multi-sided aperture 72 in the second end 70 of the operating lever 64. Each drive member 74 tapers from a first end 90 adjacent the movable downstream portion 42 of the respective variable vane 38 to a second end 92 remote from the movable downstream portion 42 of the respective variable vane 38. Thus the cross-sectional area of the drive member 74 increases from the first end 90 to the second end 92. The sides on the inner surface 86 taper from the first end 90 to the second end 92 and the sides on the outer surface 88 taper from the first 90 end to the second end 92. Each drive member 74 comprises a base portion 94 and a plurality of portions 96, 98 corresponding in number to the number of sides of the aperture 72 and the spindle 60, extending into the respective multi-sided aperture 72. Each drive member 74 comprises a ductile material, for example the ductile material comprises titanium, a plastic or other suitable material.

The base portion 94 of each drive member 74 is secured to the spindle 60 of the movable downstream portion 42 of the respective variable vane 38 by a screw, or a bolt, 100. Each screw, or bolt, 100 extends though an aperture 102 in the base portion 94 of the drive member 74 and into a threaded aperture 104 in the spindle 60 of the variable vane 38. Each multi-sided aperture 72 comprises three, four, five, six or more sides, each multi-sided spindle 60 has an equal number of sides to the respective multi-sided aperture 72 in the second end 70 of the operating lever 64.

Each aperture 72 in the second end 70 of the respective operating lever 64 has a increased dimension seating position 112 at the end 80 remote from the movable downstream portion 42 of the variable vane 38. The seating position 112 has substantially the same dimensions and shape as the base portion 94 of the respective drive member 74. The base portion 94 of the drive member 74 locates on the seating position 112 in the aperture 72 in the operating lever 64 when the bolt 100 is fully tightened. In this example the seating position 112 and the base portion 94 are circular, but other suitable shapes may be used.

The first end 68 of each operating lever 64 is pivotally mounted to the control ring 66 by a respective pin, or bolt, 106. Each pin, or bolt, 106 passes through an aperture 108 in the first end 68 of the operating lever 64 and the pin, or bolt, 106 is secured, threaded, into apertures 109, 110 in the control ring 66.

The control ring 66 is arranged coaxially around the axis X of the rotor 32 of the intermediate-pressure compressor 26 and is rotatably mounted on the casing 30 so as to vary the angles of the variable vanes 38. An actuator (not shown) is provided to rotate the control ring 66 and the actuator may be a hydraulic, pneumatic or electric actuator.

Each aperture 46 in the casing 30 has a generally cylindrical portion 45 and a slot 47 extending radially relative to the cylindrical portion 45 of the aperture 46 and extending axially in a downstream direction relative to the casing 30. Thus it is seen that each aperture 46 is substantially keyhole shape in cross-section. The increased diameter portion 62 of each aperture 46 is also elongated axially in a downstream direction. Each aperture 46 has a bush 120, which has a generally tubular portion 122 and a projection 124 extending radially relative to the tubular portion 122 of the bush 120. Thus each bush 120 is substantially keyhole shape in cross-section and is arranged to have the same dimensions as the respective aperture 46. Each bush 120 has a flange 126 at its end remote 128 from the movable downstream portion 42 of the variable vane 38, which abuts the boss of the casing 30. The spindle 60, the second end 70 of the operating lever 64 and the drive member 74 are located in the tubular portion 122 of the bush 120.

To assemble the variable vane arrangement 36 the movable downstream portion 42 of each variable vane 38 is located in the casing 30 and the spindle 60 is inserted into the inner end of the respective aperture 46 in the casing 30. The increased clearance provided by the slot 47 of the aperture 46 and the recess 62 in the casing 30 allows the movable downstream portion 42 of the variable vane 38 to be manoeuvred into position. The spindle 60 is inserted into the downstream end of the slot 47 of the aperture 46. Then the spindle 60 is moved axially in an upstream direction until the centres of the spindle 60 and the bearing member 58 are aligned with the cylindrical portion 45 of the aperture 46. At this position the spindle 60 and the bearing member 58 are on the pivot axis Y. A bush 120 is then inserted into the respective aperture 46 around the spindle 60 to fill the slot 45 of the aperture 46. The second end 70 of the operating lever 64 is then loaded into the radially outer end of the respective aperture 46 in the casing 30 within the bush 120 and around the spindle 60 on the movable downstream portion 42 of the respective variable vane 38. The movable downstream portion 42 of the variable vane 38 may be further adjusted and set in position along with any end float. The drive member 74 is then loaded into the aperture 72 in the second end 70 of the operating lever 64. The bolt 100 is then used to secure the drive member 74 and second end 70 of the operating lever 64 to the spindle 60 of the variable vane 38. The tightening of the bolt 100 causes the drive member 74 to grip the spindle 60 of the variable vane 38 and to pull the drive member 74 into the seating position 112 around the aperture 72 in the second end 70 of the operating lever 64. Any variation in geometry and/or tolerance is taken up either by movement of the drive member 74 along the taper or by deformation of the drive member 74. Once fully assembled substantially zero backlash is achieved in the drive between the operating lever 64 and the spindle 60 of the variable vane 38, thus eliminating errors in the angle setting of the variable vane 38.

The spindle 54 of the movable downstream portion 42, and the associated bush 56, of each variable vane 38 is inserted into the upstream portion of the respective aperture 48 in the upstream portion 44A of the ring 44 at any time after the spindle 60 of the movable downstream portion 42 of the variable vane 38 has been inserted into the respective aperture 48 in the casing 30. The downstream portion 44B of the ring 44 is then secured to the upstream portion 44A of the ring 44, to complete the apertures 46 around the spindles 54 of the movable downstream portion 42 of the variable vanes 38, by fastening the flanges together using the bolts and nuts.

Alternatively the bush may simply have a tubular portion and a separate member may be provided to fill the slot 45 of the aperture 46.

The present variable vane arrangement has many advantages. The keyhole shaped aperture allows the movable downstream portion of the vane to be moved axially during assembly, and/or disassembly, of the variable vane arrangement and so enables a smaller gap to be produced between the radially outer ends of the downstream end of the upstream portion of the vane and the radially outer ends of the upstream end of the downstream portion of the vane. This results in a variable vane arrangement with a smaller gap between the whole of the downstream end of the upstream portion of the vane and the whole of the upstream end of the downstream portion of the vane. This reduces any leakage flows between the downstream end of the upstream portion of the vane and the upstream end of the downstream portion of the vane which may be a source of aerodynamic forcing on the stage of rotor blades immediately downstream of the vanes. The bush in the aperture prevents leakage of working fluid out of the casing. The radially outer end of the aerofoil of the downstream portion of each variable vane tapers to an increased thickness. The increased thickness at the radially outer end of the aerofoil is aligned with and masks the elongate recess in the casing and reduces, preferably prevents, leakage of air from the concave pressure surface to the convex suction surface of the aerofoil of the downstream portion of each variable vane.

The variable vane arrangement may be a variable inlet guide vane for the compressor or the variable vane arrangement may be arranged at any other suitable position in the compressor.

Although the present invention has been described with reference to the use of a variable vane arrangement comprising variable vanes with a fixed upstream portion and a movable downstream portion it may be used for a variable vane arrangement where the upstream portion is movable and the downstream portion is fixed.

Although the present invention has been described with reference to the use of a variable vane arrangement for a compressor it may be used for a variable vane arrangement for a fan or a turbine.

Although the present invention has been described with reference to the use of a variable vane arrangement for an intermediate-pressure compressor it may be used for a high-pressure compressor, a low-pressure compressor or a fan.

Although the present invention has been described with reference to a variable vane arrangement for a turbofan gas turbine engine it may be used for a turbojet gas turbine engine, a turboprop gas turbine engine, an industrial gas turbine engine or a marine gas turbine engine.

Although the present invention has been described with reference to the use of a variable vane arrangement for a gas turbine engine it may be used for a variable vane arrangement for any other type of turbomachine.

Although the present invention has been described with reference to a variable vane arrangement for an axial flow arrangement it may be used for a radial flow arrangement.

Although the present invention has been described with reference to a variable vane arrangement with an axially elongate aperture it may be possible to have a circumferentially elongate aperture or an aperture elongate with axial and circumferential components.

We claim:

1. A variable vane arrangement for a turbomachine comprising a plurality of circumferentially arranged vanes, a plurality of operating levers and a control ring, each vane comprising a fixed portion secured to a casing of the turbomachine and a movable portion pivotally mounted to the casing, each operating lever being pivotally mounted at a first end to the control ring, each operating lever being mounted at a second end to a respective one of the vanes, the movable portion of each vane being movable between a first position in which the movable portion of each vane is pivotally moved about an axis at an end of the movable portion and the axis is adjacent the fixed portion of the respective vane and a second position in which the movable portion of each vane is displaced from the fixed portion of the respective vane to allow assembly or disassembly of the movable portion of each vane.

2. A variable vane arrangement as claimed in claim 1 wherein the end of the fixed portion of each vane having substantially the same shape as the adjacent end of the movable portion of the respective vane.

3. A variable vane arrangement as claimed in claim 1 wherein each variable vane comprises an upstream portion fixed to the casing and a movable downstream portion pivotally mounted to the casing.

4. A variable vane arrangement as claimed in claim 1 wherein the variable vanes are pivotally mounted about pivot axes arranged substantially radially to the axis of the turbomachine.

5. A variable vane arrangement as claimed in claim 4 wherein each elongate shape aperture extends substantially axially relative to the axis of the turbomachine.

6. A variable vane arrangement as claimed in claim 1 wherein the turbomachine is a gas turbine engine.

7. A variable vane arrangement as claimed in claim 6 wherein the turbomachine is a turbojet or turbofan gas turbine engine.

8. A variable vane arrangement as claimed in claim 6 wherein the variable vane arrangement is for a compressor or a fan.

9. A variable vane arrangement for a turbomachine comprising a plurality of circumferentially arranged vanes, a plurality of operating levers and a control ring, each vane comprising a fixed portion secured to a casing of the turbomachine and a movable portion pivotally mounted to the casing, each operating lever being pivotally mounted at a first end to the control ring, each operating lever being mounted at a second end to a respective one of the vanes, the movable portion of each vane being movable between a first position in which the movable portion of each vane is pivotally moved about an axis at an end of the movable portion and the axis is adjacent the fixed portion of the respective vane and a second position in which the movable portion of each vane is displaced from the fixed portion of the respective vane to allow assembly or disassembly of the movable portion of each vane wherein the movable portion of each vane having a spindle arranged to extend through a respective aperture in the casing, each aperture in the casing having an elongate shape in cross-section to allow the movable portion of each vane to move between the first position and the second position.

10. A variable vane arrangement as claimed in claim 9 wherein each aperture having a bush arranged within the aperture and around the spindle to fill the elongate shaped aperture when the movable portion of each vane is in the first position.

11. A variable vane arrangement as claimed in claim 9, wherein each aperture is generally keyhole shape in cross-section.

12. A variable vane for a turbomachine comprising a fixed portion secured to a casing of the turbomachine and a movable portion pivotally mounted to the casing, the movable portion of the vane being movable between a first position in which the movable portion of the vane is pivotally moved about an axis at an end of the movable portion and the axis is adjacent the fixed portion of the vane and a second position in which the movable portion of the vane is displaced from the fixed portion of the vane to allow assembly or disassembly of the movable portion of the vane.

13. A variable vane arrangement as claimed in claim 12 wherein the end of the fixed portion of the vane has substantially the same shape as the adjacent end of the movable portion of the vane.

14. A variable vane for a turbomachine comprising a fixed portion secured to a casing of the turbomachine and a movable portion pivotally mounted to the casing, the movable portion of the vane being movable between a first position in which the movable portion of the vane is pivotally moved about an axis at an end of the movable portion and the axis is adjacent the fixed portion of the vane and a second position in which the movable portion of the vane is displaced from the fixed portion of the vane to allow assembly or disassembly of the movable portion of the vane wherein the movable portion of the vane has a spindle arranged to extend through an aperture in the casing, the aperture in the casing having an elongate shape in cross-section to allow the movable portion of the vane to move between the first position and the second position.

15. A variable vane as claimed in claim 14 wherein the aperture has a bush arranged within the aperture and around the spindle to fill the elongate shaped aperture when the movable portion of the vane is in the first position.

* * * * *